United States Patent [19]

Goodwin

[11] 4,055,207

[45] Oct. 25, 1977

[54] UNITARY CLUB RETAINER FOR GOLF BAGS

[76] Inventor: Joseph E. Goodwin, 414 W. Fourth, Russellville, Ark. 72801

[21] Appl. No.: 696,924

[22] Filed: June 17, 1976

[51] Int. Cl.[2] ..... A63B 55/00

[52] U.S. Cl. ..... 150/1.5 R

[58] Field of Search ..... 150/1.5 R; 248/96; 273/32, 62, 77

[56] References Cited

U.S. PATENT DOCUMENTS

| | | | |
|---|---|---|---|
| 1,840,183 | 1/1932 | Blitch | 150/1.5 R |
| 1,849,610 | 3/1932 | Boyce | 150/1.5 R |
| 2,436,687 | 2/1948 | Corbett | 150/1.5 R |
| 2,534,096 | 12/1950 | Zapoleon | 150/1.5 R |
| 2,607,382 | 8/1952 | Le Vine | 150/1.5 R |
| 2,679,876 | 6/1954 | Schall | 150/1.5 R |
| 2,879,819 | 3/1959 | Turnbull | 150/1.5 R |
| 3,534,795 | 10/1970 | Wiedenmeier | 150/1.5 R |
| 3,941,398 | 3/1976 | Nelson | 150/1.5 R |

FOREIGN PATENT DOCUMENTS

| | | | |
|---|---|---|---|
| 324,771 | 2/1930 | United Kingdom | 150/1.5 |

*Primary Examiner*—Ro E. Hart

*Attorney, Agent, or Firm*—Robert Brown, Jr.

[57] ABSTRACT

A unitary golf bag head for arranging a set of golf clubs in a series of downwardly and forwardly pitched tiers, and for releasably securing and/or resiliently clamping the heads of the clubs in fixed staggered positions relative to one another.

4 Claims, 11 Drawing Figures

Fig. 3
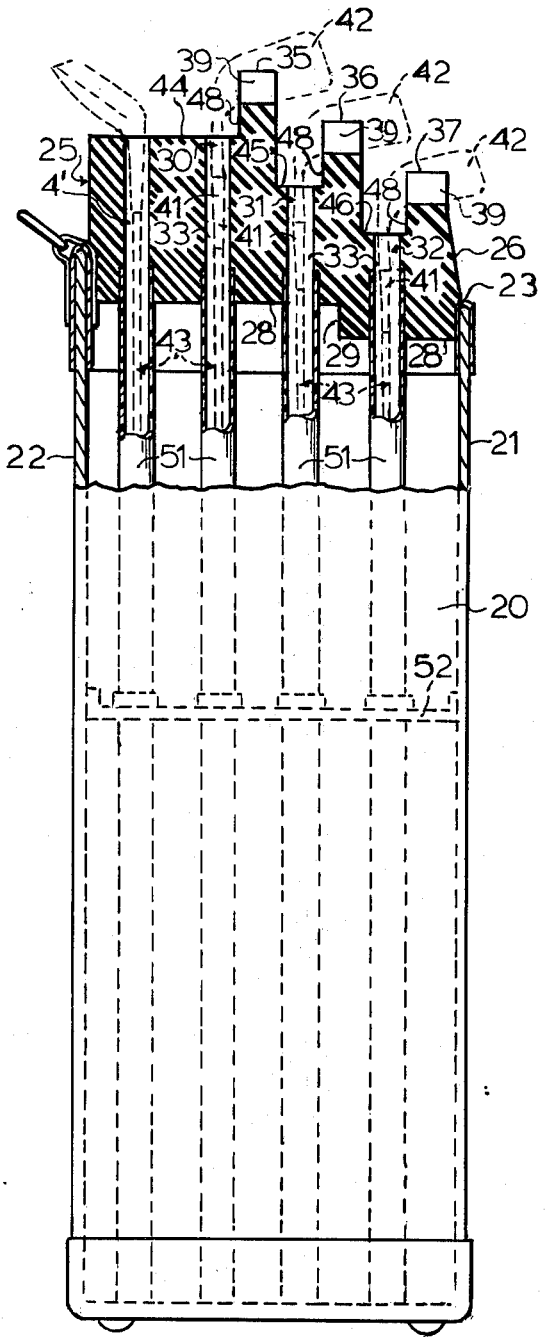
Fig. 2
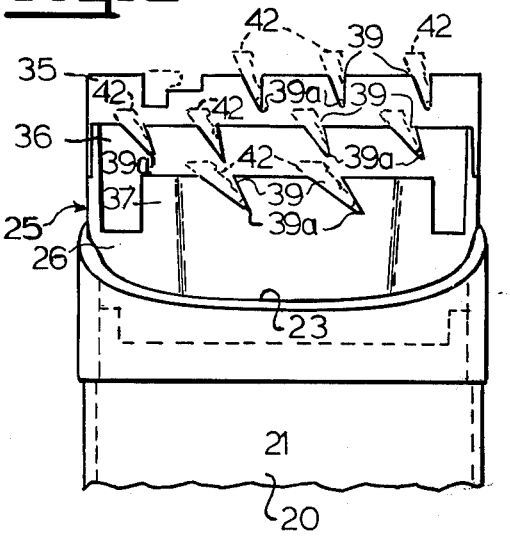
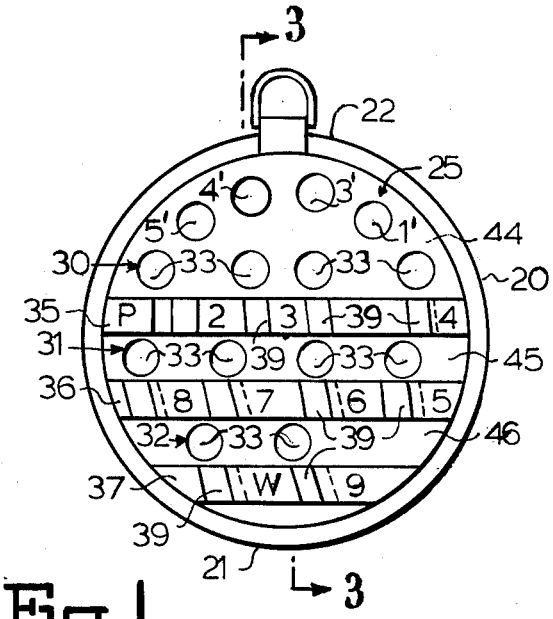
Fig. 1

UNITARY CLUB RETAINER FOR GOLF BAGS

This invention relates to golf bags and more especially to a molded one-piece retainer therefor which facilitates insertion, retention and removal of golf playing irons.

Due to the limited cross-sectional area of golf bag upper openings or mouths, the provision of a satisfactory predetermined spaced arrangement of the playing clubs within the bag has remained a difficult problem for many years. Heretofore, numerous separating devices have been devised to prevent contact of the club heads one with another and to space them orderly and in accessible positions, only to find that such added devices utilized space badly needed by the player when removing, replacing and selecting the clubs. U.S. Pat. Nos. 2,436,687, 2,879,819 and 3,534,795 disclose typical examples of such prior art devices.

It is therefore an object of this invention to provide a novel one-piece golf bag head for releasably suspending playing irons in inverted upright predetermined positions. More specifically, the head comprises a body member having parallel upstanding ribs subdividing its upper surface into corresponding alternately spaced lower stepped levels. A row of parallel shaft-receiving passageways extend downwardly at right angles from each lower stepped level and through the head. In suspended position, the shaft of each iron occupies a passageway while the corresponding blade thereof rests transversely of and in a forwardly projecting position upon the adjacent rib.

It is another object of the invention to resiliently and releasably clamp each of the rib-supported forwardly projecting blades in a position parallel to the other blades. It is a further object of the invention to stagger the blades in each row with the blades in the adjacent row or rows to thereby minimize contact during removal and replacement from and to clamped positions.

It is yet another object of the invention to provide a one-piece molded golf club retainer of the class described which is simple in construction, more convenient to use, and relatively economical to manufacture.

Some of the objects of the invention having been stated, other objects will appear as the description proceeds when taken in connection with the accompanying drawings, in which, FIG. 1 is a top plan view of a golf bag head according to my invention and as it appears when installed in the open upper end of a golf bag;

FIG. 2 is a front elevation of FIG. 1, showing the golf bag head and the upper portion of a golf bag;

FIG. 3 is a view taken along line 3—3 in FIG. 1, showing the head and the upper portion of the bag in section and the lower portion of the bag in elevation;

Figure 4:
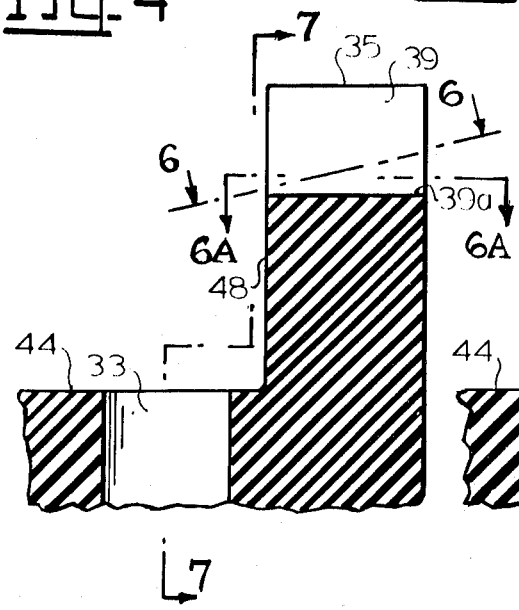
FIG. 4 is a vertical sectional view through a typical shaft passageway and blade retainer notch for a golf club, the club being omitted.

Referring more particularly to the drawings, the numeral 20 denotes a conventional golf bag having a front side 21, a back side 22 and an upper end or mouth 23, said mouth being sloped downwardly from the back to the front side of the bag (FIGS. 1 and 2). My improved golf club retainer or head 25 is adapted to fit into the mouth of and cooperate with the bag as hereinafter described.

The head 25 is preferably molded from a suitable resilient material such as soft rubber of low density, after which, several coats of a vinyl dipping are applied to provide a smooth wearing surface. As illustrated in FIG. 1, the head is adapted to fit a bag of a circular cross-section; however, the invention is not so limited in its application, but may be embodied in bags of other shapes and styles.

More specifically, the head 25 consists of an inverted frusto-conical body member 26 adapted to fit tightly in the mouth 23 of the bag, the lower surface of said member being provided with stepped horizontal surfaces 28, 28 with a vertical surface 29 therebetween, whereby the lower surface of the head will be pitched forwardly and downwardly to conform to the slope of the bag mouth.

The upper end surface of member 26 is provided with a retaining means for the golf club irons, said means comprising surface segment levels 30, 31 and 32 extending rearwardly from the base lines of alternately spaced parallel ribs 35, 36 and 37 respectively. Each level has a row of vertically disposed flush-top shaft-receiving passageways extending downwardly therefrom (FIGS. 1 and 3), said ribs and associated levels being stepped forwardly and downwardly of the head 25 at substantially the same slopes. Each row of openings 33 cooperates with an adjacent forwardly positioned rib to support a row of clubs at a particular stepped level, that is, the top row of openings associated with level 30 cooperates with parallel rib 35, the adjacent lower row associated with level 31 with rib 36, and the lowest row associated with level 32 with rib 37. Each of the ribs 35, 36 and 37 has spaced V-shaped notches 39 in its upper side for clamping the heads or blades 42 of clubs 43 in substantially parallel and forwardly projecting positions relative to the head and golf bag.

Stated differently, the upper ends of openings 33 of each of the stepped levels 30, 31 and 32 of openings 33 are flush-top with one another and surface at stepped levels or treads 44, 45 or 46, which levels are segments of the upper surface of body member 26. The alternately spaced stepped ribs 35, 36 and 37 each surface at a relatively higher level, said ribs projecting upwardly from the respective treads 44, 45 and 46 a sufficient distance to provide a vertical wall spaces 48 between the bottoms or apices of the rib notches 39 and the tread levels therebelow. This increased height of each rib and the resultant wall space 48 renders the club heads 42 and corresponding adjacent upper shaft portion of the clubs 43 more accessible to the player. Moreover, the intersection of the wall space 48 with its associated level of flush-top openings 33 forms an elongated v-shaped groove which serves as a guide when inserting the end of the club shaft 41 into the proper opening 33.

It will be observed in FIGS. 1 and 2 that the shaft-supporting passageways or openings 33 and the corresponding blade-supporting rib notches 39 are arranged vertically and horizontally in staggered relation one with the other so that the forwardly projecting club heads 42 will be staggered, thereby minimizing contact during insertion and removal of the clubs and also providing more space between the club heads.

Figure 5:
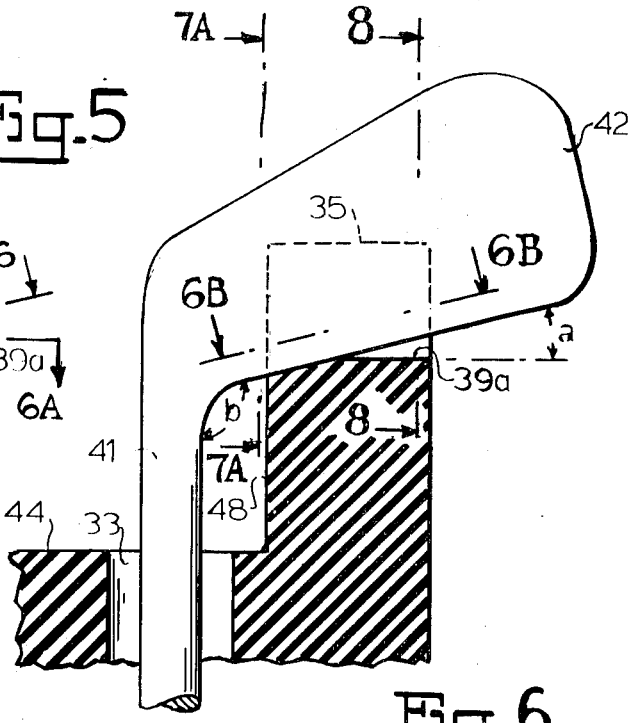
FIG. 5 is a view similar to FIG. 4, but showing the blade in supported position.
Figure 6:
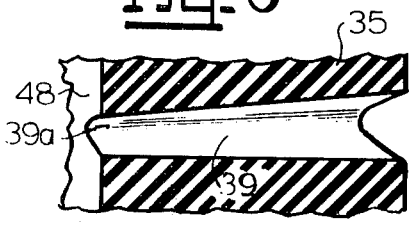
FIG. 6 is a sectional view taken along line 6—6 in FIG. 4.
Figure 7:
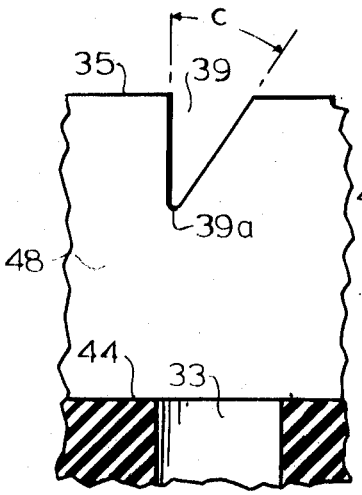
FIG. 7 is a sectional view taken along line 7—7 in FIG. 4.
Figure 7A:
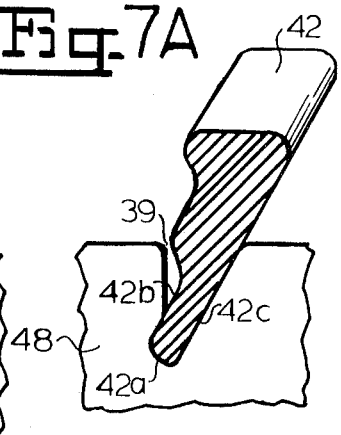
FIG. 7A is a sectional view taken along line 7A—7A in FIG. 6.
Figure 6A:
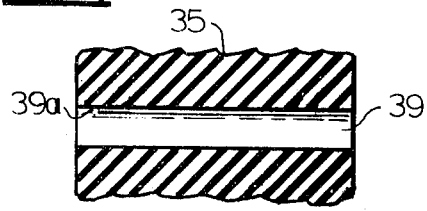
FIG. 6A is a sectional view taken along line 6A—6A in FIG. 4.
Figure 8:
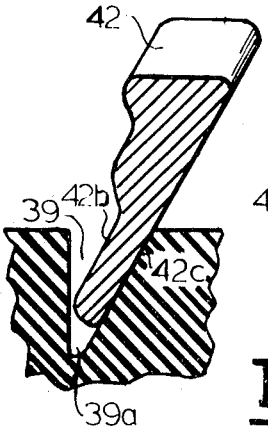
FIG. 8 is a sectional view taken along line 8—8 in FIG. 6.
Figure 6B:
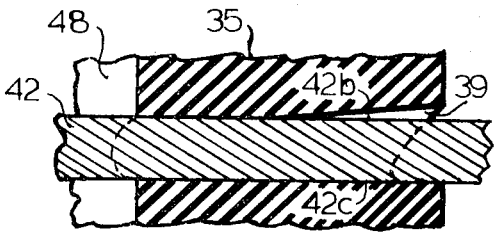
FIG. 6B is a sectional view taken along line 6B—6B in FIG. 5.

FIGS. 4 through 8 illustrate the cooperative relationship between the V-shaped notches 39 in the resilient ribs and the club heads or blades when the latter are in releasably clamped positions. It is important to note: (1) that the trough or apex 39*a* of each notch 39 is horizontally disposed, whereas the edge 42*a* of the club blade 42, when inserted into the notch, forms an acute angle "*a*" with the apex line 39*a* (FIG. 5). This acute angle is a result of conventional golf club construction in which the club head 42 forms obtuse angle "*b*" with the club shaft 41; and when the blade is in inserted position, the obtuse angle is divided by trough or apex line 39*a* into two acute angles, one of which is angle "*a*", (2) that the angularity between the opposite faces 42*b* and 42*c* of the club is less than the angularity "*c*" between the divergent faces of the notch 39; consequently, the resilient walls of the notch 39 will yieldably and laterally clamp the inserted inclined edge 42*a* of the blade or club in the manner shown in FIG. 7A, but only at the left-hand end portion of the notch (See FIG. 5). At the opposite end portion of notch 39, the surfaces 42*b* and 42*c* remain unclamped as shown in FIG. 8 since the depth of penetration of the blade is less and the distance between the notch opposed walls is greater. Thus, the clamping pressure and lateral displacement of the notch walls progressively increase with the depth of penetration of the blade edge, as illustrated in FIGS. 6, 6A and 6B.

Although the above-described clamping action is illustrated in the drawings as between the iron heads or blades 42 of golf clubs 43, substantially the same effect may be obtained as between wooded club heads and notches suitably shaped as taught by the present invention. Where, however, it is desired to clampiron head clubs only and leave the wood head clubs unclamped, suitably vertically disposed passageways 1', 3', 4' and 5' may be provided in body member 26, said passageways serving to laterally confine only the shaft portions adjacent the heads and terminating at the level 44.

If desired, each of the passageways 33, 1', 3', 4' and 5' may have a conventional tube 51 extending downwardly therefrom into bag 20 to provide added lateral support for the club shafts, said tubes being laterally supported relative to the bag by suitable means such as a center guide or diaphragm 52.

I claim:

1. A unitary golf bag head (25) for suspending playing clubs (43) in upright inverted predetermined arrangements, said clubs each having a shaft (41) with a blade (42) extending laterally from one end thereof, said head comprising:

a body member (26) having front and back sides and adapted to fit into the upper open end of said bag;

a plurality of ribs (35, 36, 37) integral with and subdividing the upper surface of said member (26) into a plurality of alternately spaced surface segment levels (44, 45, 46) each extending rearwardly from the base line of the adjacent rib;

said ribs and segment levels each being stepped forwardly and downwardly relative to the head;

said body member (26) having a row of passageways (33) extending downwardly therethrough from points disposed rearwardly adjacent the base line of each of said stepped levels, to thereby permit said club blades (42) to be vertically supported upon the ribs in substantially parallel forwardly projecting positions while the respective club shafts are laterally confined in said passageways, and means for releasably attaching said supported blades upon said ribs, wherein said ribs are made of resilient material, and wherein the attaching means for said blades includes V-shaped notches in the upper side of ribs, the angularity between the opposite faces of said blade being less than the angularity between the inner opposed faces of said notches to thereby cause the resilient walls of the notches to laterally clamp the opposite faces of said blade at the notch apices.

2. The combination defined in claim 1 wherein the horizontal of the notches in said ribs are substantially horizontal and the inserted edges of said blades form acute angles with said apices to cause magnitude of the respective clamping forces to progressively increase with the inserted depth of said edges.

3. The combination defined in claim 2 wherein the forwardly projecting blades of each row of blades are staggered with the forwardly projecting blades of at least one adjacent row of blades.

4. The combination defined in claim 3 wherein the upper end of said bag is sloped forwardly and downwardly, and wherein the lower end surface of said body member is stepped forwardly and downwardly at substantially the same pitch as that of the bag.

* * * * *